United States Patent [19]

Contois et al.

[11] 3,973,962

[45] Aug. 10, 1976

[54] AGGREGATE PHOTOCONDUCTIVE COMPOSITION CONTAINING COMBINATION OF PYRYLIUM DYE SALTS

[75] Inventors: Lawrence E. Contois, Webster; Norman G. Rule, Rochester; William J. Staudenmayer, Pittsford, all of N.Y.

[73] Assignee: Eastman Kodak Company, Rochester, N.Y.

[22] Filed: May 2, 1974

[21] Appl. No.: 466,110

[52] U.S. Cl. ..... 96/1.6; 96/1.5; 96/1.7

[51] Int. Cl.[2] ..... G03G 5/09; G03G 5/06

[58] Field of Search ..... 96/1.6, 1.5, 1.7

[56] References Cited

UNITED STATES PATENTS

| | | | |
|---|---|---|---|
| 3,250,615 | 5/1966 | Van Allan et al. | 96/1 R |
| 3,615,414 | 10/1971 | Light | 96/1.6 |
| 3,615,418 | 10/1971 | Staudenmayer | 96/1.6 |
| 3,679,408 | 7/1972 | Kryman et al. | 96/1.6 |

*Primary Examiner*—David Klein
*Assistant Examiner*—John R. Miller
*Attorney, Agent, or Firm*—John R. Everett

[57] ABSTRACT

An aggregate or heterogeneous multiphase photoconductive composition containing a continuous polymer phase and at least one discontinuous phase dispersed in said continuous phase, said discontinuous phase comprising a co-crystalline complex of (i) at least one polymer having an alkylidene diarylene group in a recurring unit (ii) at least one pyrylium type dye salt having a non-light absorbing anion, and (iii) at least one pyrylium type dye salt having a colored organic or organo-metallic anion of a strong acid.

7 Claims, No Drawings

AGGREGATE PHOTOCONDUCTIVE COMPOSITION CONTAINING COMBINATION OF PYRYLIUM DYE SALTS

Cross-reference is made to copending U.S. patent application Ser. No. 466,091, filed concurrently herewith, and entitled "New Dye Compositions".

FIELD OF THE INVENTION

This invention relates to electrophotography and particularly to dye sensitizer materials for photoconductive compositions.

BACKGROUND OF THE INVENTION

Electrophotographic imaging processes and techniques have been extensively described in both the patent and other literature, for example, U.S. Pat. Nos. 2,221,776; 2,277,013; 2,297,691; 2,357,809; 2,551,582; 2,825,814; 2,833,648; 3,220,324; 3,220,831; 3,220,833 and many others. Generally, these processes have in common the steps of employing a photoconductive insulating element which is prepared to respond to imagewise exposure with electromagnetic radiation by forming a latent electrostatic charge image. A variety of subsequent operations, now well-known in the art, can then be employed to produce a permanent record of the image.

One type of photoconductive insulating element particularly useful in electrophotography employs a composition containing a photoconductive insulating material and optionally an electrically insulating film-forming resinous binder material. A unitary electrophotographic element incorporating such a composition is generally produced in a multilayer type of structure by coating a layer of the above-described composition onto a support previously overcoated with a layer of a conducting material. Alternatively, the above-described composition can be coated directly onto a conductive support of metal or other suitable conductive material.

Typically, it is desirable to improve the speed and/or spectral response of photoconductive compositions generally employed in electrophotographic processes by incorporating in such compositions various sensitizer materials and addenda. Among the various sensitizer addenda which have been found especially effective for use in photoconductive compositions are the dyes selected from the group consisting of pyrylium, selenapyrylium, and thiapyrylium dye salts such as are disclosed in U.S. Pat. Nos. 3,250,615; 3,141,770; 3,679,408; and 3,615,418. Generally, the aforementioned pyrylium, thiapyrylium, and selenapyrylium dye salts heretofor used in photoconductive compositions have been found effective to change the sensitivity or electrical speed of a particular photoconductive composition. Although the mechanism of such sensitization is presently not fully understood, the phenomenon has been found extremely useful.

The importance of such effects is evidenced by the extensive search currently conducted by workers in the art for compositions and compounds which are capable of photosensitizing photoconductive compositions in the manner described.

Usually the desirability of a change in electrophotographic properties is dictated by the end use contemplated for the photoconductive element. For example, in document copying applications the spectral electrophotographic response of the photoconductor should be capable of reproducing the wide range of colors which is normally encountered in such use. If the response of the photoconductor falls short of these design criteria, it is highly desirable if the spectral response of the composition can be altered by the addition of photosensitizing addenda to the composition. Likewise, various applications specifically require other characteristics such as the ability of the element to accept a high surface potential, and exhibit a low dark decay of electrical charge. It is also desirable for the photoconductive element to exhibit high speed as meansured in an electrical speed or characteristic curve, a low residual potential after exposure and resistance to fatigue. Sensitization of many photoconductive compositions by the addition of certain dyes selected from the large number of dyes presently known has hitherto been widely used to provide for the desired flexibility in the design of photoconductive elements in particular photoconductor-containing systems. Conventional dye addenda to photoconductor compositions have generally shown only a limited capability for overall improvement in the totality of electrophotographic properties which cooperate to produce a useful electrophotographic element or structure. The art is still searching for improvements in shoulder and toe speeds, improved solid area reproduction characteristics, rapid recovery and useful electrophotographic speed from either positive or negative electrostatic charging.

A high speed "heterogeneous" or "aggregate" photoconductive system has been developed which overcomes many of the problems of the prior art. This aggregate composition and certain components thereof are the subject matter of William A. Light, U.S. Pat. No. 3,615,414 issued Oct. 26, 1971 and Gramza et al. U.S. Pat. No. 3,732,180 issued May 8, 1973. The addenda disclosed therein are responsible for the exhibition of desirable electrophotographic properties in photoconductive elements prepared therewith. However, use of the pyrylium type sensitizing dyes described therein quite often results in an aggregate photoconductive system which exhibits an absorption minimum (and therefore a somewhat lower sensitivity than would be desired) to light in some portion of the visible spectrum, for example, in the blue region of the spectrum, i.e. light having a wavelength within the range of from about 400 to about 500 nm. Accordingly, there is a need in the art for means of obtaining high speed aggregate photoconductive compositions which can be selectively modified to provide improved spectral response in those regions of the electromagnetic spectrum where the aggregate composition exhibits somewhat lower absorption than is desired.

SUMMARY OF THE INVENTION

In accord with the present invention it has been found that the high speed heterogeneous or aggregate photoconductive compositions of William A. Light may be improved by incorporating therein at least two different pyrylium type dye salts, namely conventional pyrylium type dye salts as described in U.S. Pat. Nos. 3,615,418 and 3,679,408 and pyrylium type dye salts having a colored organo or organo-metallic anion of a strong acid, said anion exhibiting a light absorption maxima within the range of from about 400 to about 700 nm. (The term "pyrylium type dye salts" is defined herein to include pyrylium, thiapyrylium and selenapyrylium dye salts.)

In accord with the various embodiments of the invention, each of the above-described pyrylium type dye salts contained in the resultant heterogeneous photoconductive composition, are aggregated with a polymeric material of the type described in the above-referenced William A. Light and Gramza et al patents to form a co-crystalline complex of the dyes and polymer. The resultant co-crystalline material may be used alone in particulate form in photoconductive insulating compositions as the active photoconductive species thereof. Or, the co-crystalline material may be used in admixture with other photoconductive compounds, including organic and inorganic photoconductive compounds, and various optional sensitizing addenda in heterogeneous photoconductive insulating compositions.

The improved aggregate photoconductive compositions of the present invention, in general, exhibit several advantages over previous aggregate compositions. For example, among others, it has been found that the present invention provides the means for selectively modifying the absorption and sensitivity of conventional aggregate compositions to obtain increased absorption in those areas of the visible spectrum where, depending upon the particular application or end use, it may be desirable to do so, thereby providing increased sensitivity to visible light corresponding to those regions of the spectrum. In addition, although previously developed aggregate photoconductive compositions exhibit relatively high speed, it has been found that certain of the improved aggregate compositions of the present invention may provide even higher electrophotographic speeds.

DESCRIPTION OF THE PREFERRED EMBODIMENTS

The colored organo and organo-metallic anions used in the dye salts of the present invention are the anions of strong acids. Anions of strong acids are typically characterized by the presence of one or more sulfonic, ie. $-SO_3^-$; phosphonic, $>PO_3H^-$; carboxylate, ie. $-COO^-$; or other similar strongly dissociating groups chemically bonded thereto. Anions of strong acids, as defined herein, are anions of acids sufficiently strong so that the anion of the acid, ie. the conjugate base of the acid, is incapable of attacking and opening the ring of the pyrylium, thiapyrylium, or selenapyrylium cation contained in the dye salts used in the invention. Especially useful anions of strong acids are anions of acids having a pKa of less than about 3.5.

The coloration of the organo and organo-metallic anions used in the invention is due to the presence of one or more chromophoric groups having an absorption peak within the visible spectrum extending from about 400 to about 700 nm. The chromophoric group may be selected from a variety of organic and organometallo dyestuffs such as azo; methine, such as merocyanine and hemioxanol; aminonaphthalimide; oxazone; dioxazine; etc. These and other useful classes of dyes can be found in the Preamble to the *Colour Index*, Volume 4, Third Edition, 1971.

In accord with an especially useful embodiment of the invention, the colored anion is selected as an anion containing one or more sulfonic groups and one or more azo chromophoric groups, said anion having an absorption peak within the range of from about 400 to about 700 nm. Especially useful such anions are anions represented by the following structural formula:

$$R-N=N-R-(N=N-R)_x \qquad \text{I}$$

wherein X is 0 or 1, R represents a substituted or unsubstituted group containing a sulfonic anion. Typical aryl groups include mono and polycyclic aryls having 6 to 14 carbon atoms in the aryl ring. Any of a variety of substituents may be present in the aryl group including, for example, halogens such as chlorine, bromine, or iodine; hydroxy groups; alkoxy groups, for example branched and straight chain alkoxy groups having 1 to about 15 carbon atoms; alkyl groups, for example alkyls having 1 to about 15 carbon atoms including substituted alkyls such as halo alkyls, hydroxy alkyls, alkoxy-substituted alkyls, amino substituted alkyls, aryl-substituted alkyls such as phenyl alkyls, etc.; amino groups including mono and disubstituted amino groups such as alkyl- and aryl-substituted amino groups as well as alkaryl- and aralkyl-substituted amino groups. The sulfonic group or groups which is present in the above-described anion may be bonded directly to an aryl group denoted as R in formula I above or the sulfonic group or groups may be linked to the aryl nucleus through one of the above-noted substituents which may be attached to the aryl nucleus.

Typical anions of strong acids include both monovalent and polyvalent anions. A partial list of representative such anions includes the following materials:

A. Monovalent Anions

1.

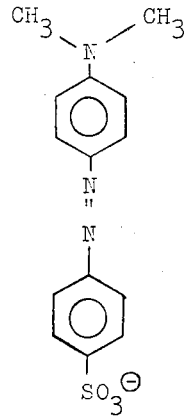

an azo dye anion having an absorption peak in ethanol at 421 nm.

2.

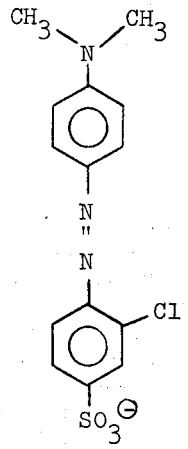

an azo dye anion having an absorption peak in ethanol at 436 nm.

3.

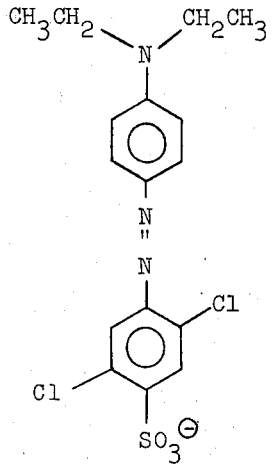

an azo dye anion having an absorption peak in ethanol at 458 nm.

3a.

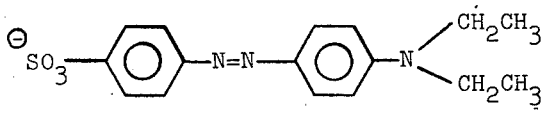

an azo anion having an absorption peak in ethanol at 430 nm.

4.

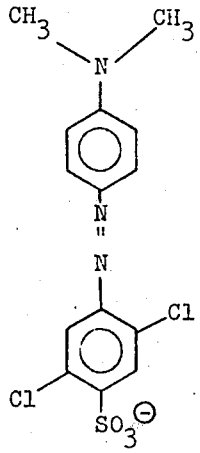

an azo dye anion having an absorption peak in ethanol at 446 nm.

4(a).

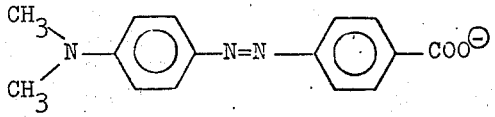

an azo anion.

5.

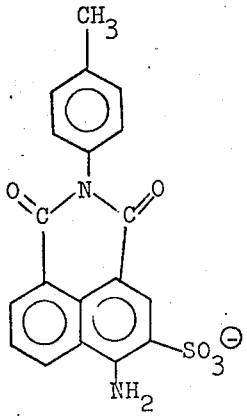

a non-azo dye anion, specifically the anion of Colour Index Acid Yellow 7, Colour Index No. 56205 of the Third Edition of the *Colour Index*. This anion is an example of an aminonaphthalimide dye anion.

6.

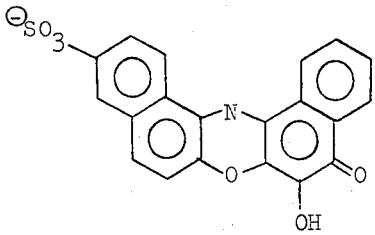

a non-azo dye anion, specifically the anion of Alizarine Green, Colour Index No. 51405 of the Third Edition of the *Colour Index*. This anion is an example of an oxazone dye anion.

7. picrate anion

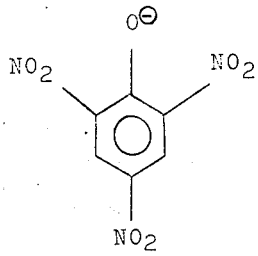

B. Polyvalent Anions

1.

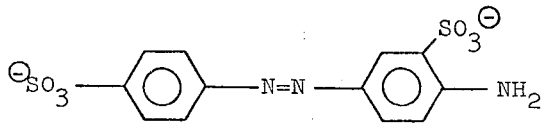

an azo dye anion, specifically the anion of Colour Index Acid Yellow 9, Colour Index No. 13015 of the Third Edition of the *Colour Index*.

2.

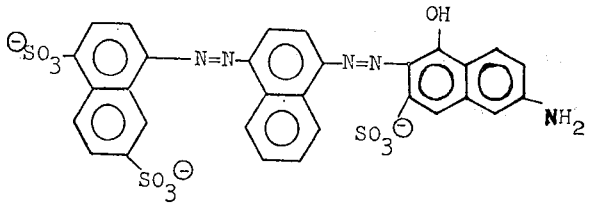

an azo dye anion, specifically the anion of Benzo Fast Blue 5R, Colour Index No. 27645 of the Third Edition of the *Colour Index*.

3.

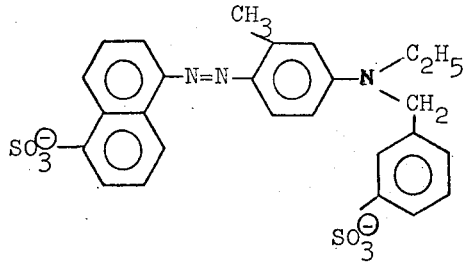

an azo dye anion, specifically the anion of Sulfon Orange 5G, Colour Index No. 13185 of the Third Edition of the *Colour Index*.

4.

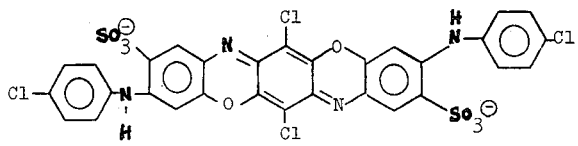

a non-azo dye anion, specifically the anion of Colour Index Direct Blue 190, Colour Index No. 51300 of the Third Edition of the *Colour Index*.

5. $Fe(C_2O_4)_3^{-3}$, the ferrioxalate anion which is an example of an organo-metallic anion.

6. $Fe(CN)_6^{-3}$, the [hexacyanoferrate (III)] anion, an example of an organometallic trivalent ferricyanide anion.

The colored anion-containing pyrylium type dye salts used in the present invention may be prepared by the double decomposition, i.e., metathesis, of two aqueous alcohol soluble salts. In general, this is accomplished by forming a first solution of a conventional pyrylium dye salt containing the desired pyrylium cation, for example, an aqueous alcoholic solution of 4-(4′-dimethylaminophenyl)-2,6-diphenyl thiapyrylium chloride, and then adding a second solution of a sodium salt of an acidic dyestuff containing the desired colored organo or organo-metallic anion, for example an aqueous solution of Methyl Orange, E. K. 432, to the first solution. As a result, a pyrylium dye salt precipitate composed of the pyrylium cation and the colored organo or organo-metallic anion of the acidic dyestuff is formed. For instance, in the example presented immediately above, 4-(4′-dimethylaminophenyl)-2,6-diphenylthiapyrylium 4-(4′-dimethylaminophenylaxo)benzenesulfonate is formed.

The pyrylium dye cations used in the present invention, as suggested above, may be obtained from conventional pyrylium dye salts which are described in some detail hereinafter. Conventional pyrylium dye salts have substantially colorless anionic functions exhibiting substantially no absorption of visible light (ie., light having a wavelength within the range of from about 400 to about 700 nm.) These materials and their method of preparation are well known. For purposes of reference, further information relating to conventional pyrylium dye salt materials may be found in VanAllan et. al. U.S. Pat. No. 3,250,615 issued May 10, 1966, Staudenmayer, U.S. Pat. No. 3,615,418 issued Oct. 26, 1971, and Kryman et. al., U.S. Pat. No. 3,679,408 issued July 25, 1972.

Typical of useful pyrylium dye salts from which the pyrylium dye cations used in the present invention may be derived are materials which can be represented by the following general formula:

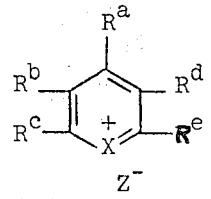

wherein $R^a$, $R^b$, $R^c$, $R^d$, and $R^e$ can each represent (a) a hydrogen atom; (b) an alkyl group typically having from 1 to 15 carbon atoms, such as methyl, ethyl, propyl, isopropyl, butyl, tertiary butyl, amyl, isoamyl, hexyl, octyl, nonyl, dodecyl, etc., (c) alkoxy groups typically having from 1 to 10 carbon atoms such as methoxy, ethoxy, propoxy, butoxy, amyloxy, hexoxy, octoxy, and the like; and (d) aryl groups, including substituted aryl groups typically having from 6 to about 10 carbon atoms in the aromatic nucleus such as phenyl, 4-diphenyl, alkylphenyls as 4-ethylphenyl, 4-propylphenyl, and the like, alkoxyphenyls as 4-ethoxyphenyl, 4-methoxyphenyl, 4-amyloxyphenyl, 2-hexoxyphenyl, 2-methoxyphenyl, 3,4-dimethoxyphenyl, and the like, β-hydroxyalkoxyphenyls as 2-hydroxyethoxyphenyl, 3-hydroxyethoxyphenyl, and the like, 4-hydroxyphenyl, halophenyls as 2,4-dichlorophenyl, 3,4-dibromophenyl, 4-chlorophenyl, 3,4-dichlorophenyl, and the like, azidophenyl, nitrophenyl, aminophenyls as 4-diethylaminophenyl, 4-dimethylaminophenyl the like, naphthyl; and vinyl substituted aryl groups such as styryl, methoxystyryl, diethoxystyryl, dimethylaminostyryl, 1-butyl-4-p-dimethylaminophenyl-1,3-butadienyl, β-ethyl-4-dimethylaminostyryl, and the like; and where X is a sulfur, oxygen or selenium atom, and $Z^-$ is a conventional substantially colorless anionic function exhibiting substantially no absorption of visible light, including such anions as perchlorate, fluoroborate, iodide, chloride, bromide, sulfate, periodate, p-toluenesulfonate, and the like. In addition, the pair $R^a$ and $R^b$ as well as the pair $R^d$ and $R^e$ can together be the necessary atoms to complete an aryl ring fused to the pyrylium nucleus. Typical members of such pyrylium dyes are listed in Table 1.

TABLE 1

| Compound Number | Name of compound |
|---|---|
| 1 | 4-[4-bis(2-chloroethyl)aminophenyl]-2,6-diphenylthiapyrylium perchlorate. |
| 2 | 4-(4-dimethylaminophenyl)-2,6-diphenylthiapyrylium perchlorate. |
| 3 | 4-(4-dimethylaminophenyl)-2,6-diphenylthiapyrylium fluoroborate. |
| 4 | 4-(4-dimethylamino-2-methylphenyl)-2,6-diphenylpyrylium perchlorate. |
| 5 | 4-[4-bis(2-chloroethyl)aminophenyl]-2-(4-methoxyphenyl)-6-phenylthiapyrylium perchlorate. |
| 6 | 4-(4-dimethylaminophenyl)2,6-diphenylthiapyrylium sulfate. |
| 7 | 4-(4-dimethylaminophenyl)-2,6-diphenylthiapyrylium p-toluenesulfonate. |
| 8 | 4-(4-dimethylaminophenyl)-2,6-diphenylpyrylium-p-toluenesulfonate. |
| 9 | 2-(2,4-dimethoxyphenyl)-4-(4-dimethylaminophenyl)-benzo(b)pyrylium perchlorate. |
| 10 | 2,6-bis(4-ethylphenyl)-4-(4-dimethylaminophenyl)-thiapyrylium perchlorate. |
| 11 | 4-(4-dimethylaminophenyl)-2-(4-methoxyphenyl)-6-phenylthiapyrylium perchlorate. |
| 12 | 4-(4-dimethylaminophenyl)-2-(4-ethoxyphenyl)-6-phenylthiapyrylium perchlorate. |
| 13 | 4-(4-dimethylaminophenyl)-2-(4-methoxyphenyl)-6-(4-methylphenyl)pyrylium perchlorate. |
| 14 | 4-(4-diphenylaminophenyl)-2,6-diphenylthiapyrylium perchlorate. |
| 15 | 2,4,6-triphenylpyrylium perchlorate. |
| 16 | 4-(4-methoxyphenyl)-2,6-diphenylpyrylium perchlorate. |
| 17 | 4-(2,4-dichlorophenyl)-2,6-diphenylpyrylium perchlorate. |
| 18 | 4-(3,4-dichlorophenyl)-2,6-diphenylpyrylium perchlorate. |
| 19 | 2,6-bis(4-methoxyphenyl)-4-phenylpyrylium perchlorate. |
| 20 | 6-(4-methoxyphenyl)-2,4-diphenylpyrylium perchlorate. |
| 21 | 2-(3,4-dichlorophenyl)-4-(4-methoxyphenyl)-6-phenylpyrylium perchlorate. |
| 22 | 4-(4-amyloxyphenyl)-2,6-bis(4-ethylphenyl)pyrylium perchlorate. |
| 23 | 4-(4-amyloxyphenyl)-2,6-bis(4-methoxyphenyl)pyrylium perchlorate. |
| 24 | 2,4,6-triphenylpyrylium fluoroborate. |
| 25 | 2,6-bis(4-ethylphenyl)-4-(4-methoxyphenyl)pyrylium perchlorate. |
| 26 | 2,6-bis(4-ethylphenyl)-4-(4-methoxyphenyl)pyrylium fluoroborate. |
| 27 | 6-(3,4-diethoxystyryl)-2,4-diphenylpyrylium perchlorate. |
| 28 | 6-(3,4-diethoxy-β-amylstyryl)-2,4-diphenylpyrylium fluoroborate. |
| 29 | 6-(4-dimethylamino-β-ethylstyryl)-2,4-diphenylpyrylium fluoroborate. |
| 30 | 6-(1-n-amyl-4-p-dimethylaminophenyl-1,3-butadienyl)-2,4-diphenylpyrylium fluoroborate. |
| 31 | 6-(4-dimethylaminostyryldiphenyl)-2,4-pyrylium fluoroborate. |
| 32 | 6-[α-ethyl-β,β-bis(dimethylaminophenyl)-vinylene]2,4-diphenylpyrylium fluoroborate. |
| 33 | 6-(1-butyl-4-p-dimethylaminophenyl-1,3-butadienyl)-2,4-diphenylpyrylium fluoroborate. |
| 34 | 6-(4-dimethylaminostyryl)-2,4-diphenylpyrylium perchlorate. |
| 35 | 6-[β,β-bis(4-dimethylaminophenyl)-vinylene]-2,4-diphenylpyrylium perchlorate. |
| 36 | 2,6-bis(4-dimethylaminostyryl)-4-phenylpyrylium perchlorate. |
| 37 | 6-(β-methyl-4-dimethylaminostyryl)-2,4-diphenylpyrylium fluoroborate. |
| 38 | 6-[1-ethyl-4-(4-dimethylaminophenyl)-1,3-butadienyl]-2,4-diphenylpyrylium fluoroborate. |
| 39 | 6-[β,β-bis(4-dimethylaminophenyl)-vinylene]-2,4-diphenylpyrylium fluoroborate. |
| 40 | 6-[1-methyl-4-(4-dimethylaminophenyl)-1,3-butadienyl]-2,4-diphenylpyrylium fluoroborate. |
| 41 | 4-(4-dimethylaminophenyl)-2,6-diphenylpyrylium perchlorate. |
| 42 | 2,6-bis(4-ethylphenyl)-4-phenylpyrylium perchlorate. |
| 43 | 2,6-bis(4-ethylphenyl)-4-methoxyphenylthiapyrylium fluoroborate. |
| 44 | 2,4,6-triphenylthiapyrylium perchlorate. |
| 45 | 4-(4-methoxyphenyl)-2,6-diphenylthiapyrylium perchlorate. |
| 46 | 6-(4-methoxyphenyl)-2,4-diphenylthiapyrylium perchlorate. |
| 47 | 2,6-bis(4-methoxyphenyl)-4-phenylthiapyrylium perchlorate. |
| 48 | 4-(2,4-dichlorophenyl)-2,6-diphenylthiapyrylium perchlorate. |
| 49 | 2,4,6-tri(4-methoxyphenyl)thiapyrylium perchlorate. |
| 50 | 2,6-bis(4-ethylphenyl)-4-phenylthiapyrylium perchlorate. |
| 51 | 4-(4-amyloxyphenyl)-2,6-bis(4-ethylphenyl)-thiapyrylium perchlorate. |
| 52 | 6-(4-dimethylaminostyryl)-2,4-diphenylthiapyrylium perchlorate. |
| 53 | 2,4,6-triphenylthiapyrylium fluoroborate. |
| 54 | 2,4,6-triphenylthiapyrylium sulfate. |
| 55 | 4-(4-methoxyphenyl)-2,6-diphenylthiapyrylium fluoroborate. |
| 56 | 2,4,6-triphenylthiapyrylium chloride. |
| 57 | 2-(4-amyloxyphenyl)-4,6-diphenylthiapyrylium fluoroborate. |
| 58 | 4-(4-amyloxyphenyl)-2,6-bis(4-methoxyphenyl)thiapyrylium perchlorate. |
| 59 | 2,6-bis(4-ethylphenyl)-4-(4-methoxyphenyl)thiapyrylium perchlorate. |
| 60 | 4-anisyl-2,6-bis(4-n-amyloxyphenyl)-thiapyrylium chloride. |
| 61 | 2-[β,β(4-dimethylaminophenyl)-vinylene]-4,6-diphenylthiapyrylium perchlorate. |
| 62 | 6-(β-ethyl-4-dimethylaminostyryl)-2,4-diphenylthiapyrylium perchlorate. |
| 63 | 2-(3,4-diethoxystyryl)-4,6-diphenylthiapyrylium perchlorate. |
| 64 | 2,4,6-trianisylthiapyrylium perchlorate. |
| 65 | 6-ethyl-2,4-diphenylpyrylium fluoroborate. |
| 66 | 2,6-bis(4-ethylphenyl)-4-(4-methoxyphenyl)thiapyrylium chloride. |
| 67 | 6-[β,β-bis(4-dimethylaminophenyl)-vinylene]-2,4-di(4-ethylphenyl)-pyrylium perchlorate. |
| 68 | 2,6-bis(4-amyloxyphenyl)-4-(4-methoxy- |

TABLE 1-continued

| Compound Number | Name of compound |
|---|---|
| | phenyl)thiapyrylium perchlorate. |
| 69 | 6-(3,4-diethoxy-β-ethylstyryl)-2,4-diphenylpyrylium fluoroborate. |
| 70 | 6-(4-methoxy-β-ethylstyryl)-2,4-diphenylpyrylium fluoroborate. |
| 71 | 2-(4-ethylphenyl)-4,6-diphenylthiapyrylium perchlorate. |
| 72 | 2,6-diphenyl-4-(4-methoxyphenyl)-thiapyrylium perchlorate. |
| 73 | 2,6-diphenyl-4-(4-methoxyphenyl)thiapyrylium fluoroborate. |
| 74 | 2,6-bis(4-ethylphenyl)-4-(4-n-amyloxyphenyl)thiapyrylium perchlorate. |
| 75 | 2,6-bis(4-methoxyphenyl)-4-(4-n-amyloxyphenyl)thiapyrylium perchlorate. |
| 76 | 2,4,6-tris(4-methoxyphenyl)thiapyrylium fluoroborate. |
| 77 | 2,4-diphenyl-6-(3,4-diethoxystyryl)-pyrylium perchlorate. |
| 78 | 4-(4-dimethylaminophenyl)-2-phenylbenzo(b)selenapyrylium perchlorate. |
| 79 | 2-(2,4-dimethoxyphenyl)-4-(4-dimethylaminophenyl)-benzo(b)selenapyrylium perchlorate. |
| 80 | 4-(4-dimethylaminophenyl)2,6-diphenylselenapyrylium perchlorate. |
| 81 | 4-(4-dimethylaminophenyl)-2-(4-ethoxyphenyl)-6-phenylselenapyrylium perchlorate. |
| 82 | 4-[4-bis(2-chloroethyl)aminophenyl]-2,6-diphenylselenapyrylium perchlorate. |
| 83 | 4-(4-dimethylaminophenyl)-2,6-bis(4-ethylphenyl)-selenapyrylium perchlorate. |
| 84 | 4-(4-dimethylamino-2-methylphenyl)-2,6-diphenylselenapyrylium perchlorate. |
| 85 | 3-(4-dimethylaminophenyl)naphtho(2,1-b)selenapyrylium perchlorate. |
| 86 | 4-(4-dimethylaminostyryl)-2-(4-methoxyphenyl)benzo(b)selenapyrylium perchlorate. |
| 87 | 2,6-di(4-diethylaminophenyl)-4-phenylselenapyrylium perchlorate. |
| 88 | 4-(4-dimethylaminophenyl)-2-(4-ethoxyphenyl)-6-phenylthiapyrylium fluoroborate. |
| 89 | 4-benzylamino-2-phenylbenzo(b)pyrylium perchlorate. |
| 90 | 4-anilino-2-(4-methoxyphenyl)naphtho(1,2-b)pyrylium perchlorate. |
| 91 | 4-(N-butylamino)-2-phenylbenzo(b)thiapyrylium perchlorate. |
| 92 | 4-(N-butylamino)-2-(p-methoxyphenyl)-benzo(b)pyrylium perchlorate. |
| 93 | 4-(4-dimethylaminophenyl)-2-(4-ethoxyphenyl)-6-phenylthiapyrylium fluoroborate. |
| 94 | 4-(4-dimethylaminophenyl)-2,6-diphenylthiapyrylium hexafluorophosphate. |

Particularly useful dye salts from which the pyrylium dye cations used in the invention may be derived are materials having the formula:

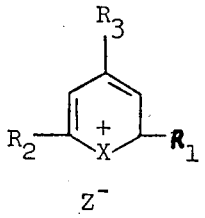

wherein: $R_1$ and $R_2$ can each be phenyl radicals, including substituted phenyl radicals having at least one substituent chosen from alkyl radicals of from 1 to about 6 carbon atoms; $R_3$ can be an alkylamino-substituted phenyl radical having from 1 to 6 carbon atoms in the alkyl group, and including dialkylamino-substituted and haloalkylamino-substituted phenyl radicals; X is a sulfur atom; $Z^-$ is the same as above.

In accordance with the present invention, the pyrylium dye salts described herein are used in forming improved "heterogeneous" or "aggregate" photoconductive compositions.

These heterogeneous photoconductive compositions have a multiphase structure containing (a) at least one discontinuous phase comprising a co-crystalline complex of (i) at least one conventional pyrylium dye salt, (ii) at least one electrically insulating, film-forming polymeric material having an alkylidene diarylene group in a recurring unit and (iii) at least one colored anion-containing pyrylium dye salt as described herein and (b) a continuous phase comprising an electrically insulating film-forming polymeric material and optionally one or more additional photoconductive and/or sensitizing addenda dissolved therein.

When the present multiphase compositions are used in conjunction with a separate particulate photoconductor, three or more phases may be present. In such case, there would be a continuous phase comprising a polymer and optionally other addenda dissolved therein, a discontinuous phase composed of the co-crystalline complex described above, and another discontinuous phase composed of the particulate photoconductor. Of course, the present multiphase compositions may also contain additional discontinuous phases.

The aggregate composition may be prepared by several techniques, such as, for example, the so-called "dye first" technique described in Gramza et. al, U.S. Pat. No. 3,615,396 issued Oct. 26, 1971. Alternatively, they may be prepared by the so-called "shearing" method described in Gramza, U.S. Pat. No. 3,615,415 issued October 26, 1971. This latter method involves the high speed shearing of the photoconductive composition prior to coating and thus eliminates subsequent solvent treatment, as was disclosed in Light, U.S. Pat. No. 3,615,414 referred to above. By whatever method prepared, the aggregate composition is added, together with other desired photoconductor or sensitizing addenda, to a suitable solvent to form a composition which is coated on a suitable support to form a separately identifiable multiphase photoconductive composition. The heterogeneous nature of this multiphase composition is generally apparent when viewed under magnification, although such compositions may appear to be substantially optically clear to the naked eye in the absence of magnification. There can, of course, be macroscopic heterogeneity. Suitably, the dye-containing aggregate in the discontinuous phase is predominantly in the size range of from about 0.01 to about 25 microns.

In general, the heterogeneous compositions formed as described herein are multiphase organic solids containing dye and polymer. The polymer forms an amorphous matrix or continuous phase which contains the discrete discontinuous phases. The discontinuous phases are the above-described aggregate species which are co-crystalline complexes comprised of dye and polymer.

The term co-crystalline complex as used herein has reference to a crystalline compound which contains dye and polymer molecules co-crystallized in a single crystalline structure to form a regular array of the molecules in a three-dimensional pattern. The combination of co-crystalline compounds used in the present invention may be employed by itself as a photoconductor in a heterogeneous photoconductive composition comprising finely-divided particles of the compounds dispersed in a suitable binder; or the combination may be used as sensitizer addenda for compositions containing one or more other kinds of photoconductors admixed in a binder.

Another feature of the heterogeneous compositions described herein as generally distinguished from previously described heterogeneous compositions such as those described in Light, U.S. Pat. No. 3,615,414 and Gramza et. al., U.S. Pat. No. 3,732,180, is the enhanced absorption and sensitivity exhibited by the improved heterogeneous compositions of the present invention in the visible region of the spectrum. As suggested above, this is believed to be caused by the colored anion incorporated in at least one of the aggregate species used in the invention. This feature of the invention is especially useful because it allows one to selectively fill absorption "holes" or "windows" which may be present within the visible absorption spectra of conventional aggregate materials. This is accomplished by using a pyrylium type dye salt containing a colored anion of a strong acid having the appropriate absorption characteristics desired to fill-in or enhance absorption in a particular region of the visible spectrum. For example, many of the azo-containing dye anions described previously herein are particularly useful because the anions exhibit absorption in the blue region of the spectrum, i.e. in the range of from about 400 to about 500 nm., which corresponds to a region where many otherwise useful conventional aggregate materials tend to exhibit an absorption window or absorption minimum.

Another feature characteristic of conventional heterogeneous compositions such as those described in U.S. Pat. Nos. 3,615,414 and 3,732,180 and certain of the improved heterogeneous compositions formed as described herein is that the wavelength of the radiation absorption maximum characteristic of such compositions is substantially shifted from the wavelength of the radiation absorption maximum of a substantially homogeneous dye-polymer solid solution formed of similar constituents. The new absorption maximum characteristic of the aggregates is not necessarily an overall maximum for the system as this will depend upon the relative amount of dye in the aggregate. The shift in absorption maximum which occurs in the formation of conventional aggregate systems is generally of the magnitude of at least about 10 nm.

As stated above, the aggregate composition of the present invention contains a co-crystalline complex of at least one conventional pyrylium type dye salt such as those described earlier herein in conjunction with Table 1, and at least one colored anion-containing pyrylium type dye salt as described earlier herein. The complex also contains an electrically insulating polymeric material as described in greater detail hereinafter. In accord with various especially useful embodiments of the invention the co-crystalline complex is typically comprised of the following weight ratios of conventional pyrylium type dye salt to colored anion-containing pyrylium type dye salt: 1:1 to 9.8:1 and preferably 3:1 to 9:1. (In each ratio the first number represents the parts by weight of the conventional pyrylium type dye salt.) Although the above-noted ratios have generally been found to provide co-crystalline complexes as described herein which give good results, co-crystalline complexes containing ratios of pyrylium type dye salts outside the abovementioned values may also yield useful results. As will be appreciated, the amount of each kind of pyrylium type dye salt contained in an individual co-crystalline complex can vary depending upon a variety of different factors such as the particular pyrylium type dye salt employed and its solubility properties, the particular polymer(s) used in forming the co-crystalline complex, the solvent compatibility of each component contained in the resultant aggregate photoconductive composition, and the like. Using co-crystalline complexes containing pyrylium type due salts corresponding to or similar to the weight ratios noted above, it has been found that one generally obtains especially improved blue sensitivity when an azo anion is employed as the colored anion in the colored anion-containing pyrylium type dye salt.

Electrically insulating, film-forming polymers useful for the formation of electrophotographic compositions containing the aggregate photoconductive compositions made by this invention include polycarbonates and polythiocarbonates, polyvinyl ethers, polyesters, poly-α-olefins phenolic resins, and the like. Mixtures of such polymers can also be used. Such polymers include those which function in the formation of the aggregates as well as functioning as binders which hold the photoconductive compositions to a suitable support. Typical polymeric materials from these classes are set out in Table 2.

TABLE 2

| Number | Polymeric Material |
|---|---|
| 1 | polystyrene |
| 2 | poly(vinyltoluene) |
| 3 | poly(vinylanisole) |
| 4 | polychlorostyrene |
| 5 | poly-α-methylstyrene |
| 6 | polyacenaphthalene |
| 7 | poly(vinyl isobutyl ether) |
| 8 | poly(vinyl cinnamate) |
| 9 | poly(vinyl benzoate) |
| 10 | poly(vinyl naphthoate) |
| 11 | poly(vinyl carbazole) |
| 12 | poly(vinylene carbonate) |
| 13 | poly(vinyl pyridine) |
| 14 | poly(vinyl acetal) |
| 15 | poly(vinyl butyral) |
| 16 | poly(ethyl methacrylate) |
| 17 | poly(butyl methacrylate) |
| 18 | poly(styrene-co-butadiene) |
| 19 | poly(styrene-co-methyl methacrylate) |
| 20 | poly(styrene-co-ethyl acrylate) |
| 21 | poly(styrene-co-acrylonitrile) |
| 22 | poly(vinyl chloride-co-vinyl acetate) |
| 23 | poly(vinylidene chloride-co-vinyl acetate) |
| 24 | poly(4,4'-isopropylidenediphenyl-co-4,4'-isopropylidenedicyclohexyl carbonate) |
| 25 | poly[4,4'-isopropylidenebis(2,6-dibromophenyl carbonate] |
| 26 | poly[4,4'-isopropylidenebis(2,6-dichlorophenyl) carbonate] |
| 27 | poly[4,4'-isopropylidenebis(2,6-dimethylphenyl)carbonate] |
| 28 | poly(4,4'-isopropylidenediphenyl-co-1,4-cyclohexyldimethylicarbonate) |
| 29 | poly(4,4'-isopropylidenediphenyl terephthalate-co-isophthalate) |
| 30 | poly(3,3'-ethylenedioxyphenyl thiocarbonate) |
| 31 | poly(4,4'-isopropylidenediphenyl carbonate-co-terephthalate) |
| 32 | poly(4,4'-isopropylidenediphenyl carbonate) |
| 33 | poly(4,4'-isopropylidenediphenyl thiocarbonate) |
| 34 | poly(2,2-butanebis-4-phenyl carbonate) |
| 35 | poly(4,4'-isopropylidenediphenyl carbonate-blockethylene oxide) |

TABLE 2-continued

| Number | Polymeric Material |
|---|---|
| 36 | poly(4,4'-isopropylidenediphenyl carbonate-blocktetramethyleneoxide) |
| 37 | poly[4,4'-isopropylidenebis(2-methylphenyl)carbonate] |
| 38 | poly(4,4'-isopropylidenediphenyl-co-1,4-phenylene carbonate) |
| 39 | poly(4,4'-isopropylidenediphenyl-co-1,3-phenylene carbonate) |
| 40 | poly(4,4' -isopropylidenediphenyl-co-4,4'-diphenyl carbonate) |
| 41 | poly(4,4'-isopropylidenediphenyl-co-4,4'-oxydiphenyl carbonate) |
| 42 | poly(4,4'-isopropylidenediphenyl-co-4,4'-carbonyldiphenyl carbonate) |
| 43 | poly(4,4'-isopropylidenediphenyl-co-4,4'-ethylenediphenyl carbonate) |
| 44 | poly[4,4'-methylenebis(2-methylphenyl)carbonate] |
| 45 | poly[1,1-(p-bromophenylethane)bis-(4-phenyl)carbonate] |
| 46 | poly[4,4'-isopropylidenediphenyl-co-sulfonylbis(4-phenyl)carbonate] |
| 47 | poly[1,1-cyclohexane bis(4-phenyl)-carbonate] |
| 48 | poly(4,4'-isopropylidenediphenoxy-dimethylsilane) |
| 49 | poly[4,4'-isopropylidene bis(2-chlorophenyl)carbonate] |
| 50 | poly[α,α,α',α'-tetramethyl-p-xylylene bis(4-phenyl carbonate)] |
| 51 | poly(hexafluoroisopropylidenedi-4-phenyl carbonate) |
| 52 | poly(dichlorotetrafluoroisoproplidene-di-4-phenyl carbonate) |
| 53 | poly(4,4'-isopropylidenediphenyl-4,4'-isopropylidenedibenzoate) |
| 54 | poly(4,4'-isopropylidenedibenzyl-4,4'-isopropylidenedibenzoate |
| 55 | poly(4,4'-isopropylidenedi-1-naphthyl carbonate |
| 56 | poly[4,4'-isopropylidene bis(phenoxy-4-phenyl sulfonate)] |
| 57 | acetophenone-formaldehyde resin |
| 58 | poly[4,4'-isopropylidene bis(phenoxy-ethyl)-co-ethylene terephthalate] |
| 59 | phenol-formaldehyde resin |
| 60 | polyvinyl acetophenone |
| 61 | chlorinated polypropylene |
| 62 | chlorinated polyethylene |
| 63 | poly(2,6-dimethylphenylene oxide) |
| 64 | poly(neopentyl-2,6-naphthalenedi-carboxylate |
| 65 | poly(ethylene terephthalate-co-isophthalate) |
| 66 | poly(1,4-phenylene-co-1,3-phenylene succinate) |
| 67 | poly(4,4'-isopropylidenediphenyl phenylphosphonate) |
| 68 | poly(m-phenylcarboxylate) |
| 69 | poly(1,4-cyclohexanedimethyl terephthalate-co-isophthalate) |
| 70 | poly(tetramethylene succinate) |
| 71 | poly(phenolphthalein carbonate) |
| 72 | poly(4-chloro-1,3-phenylene carbonate) |
| 73 | poly(2-methyl-1,3-phenylene carbonate) |
| 74 | poly(1,1-bi-2-naphthyl thiocarbonate) |
| 75 | poly(diphenylmethane bis-4-phenyl carbonate) |
| 76 | poly[2,2-(3-methylbutane)bis-4-phenyl carbonate] |
| 77 | poly[2,2-(3,3-dimethylbutane)bis-4-phenyl carbonate] |
| 78 | poly 1,1-[1-(1-naphthyl)]bis-4-phenyl carbonate |
| 79 | poly[2,2-(4-methylpentane)bis-(4-methylpentane)bis-phenyl carbonate] |
| 80 | poly[4,4'(2-norbornylidene)diphenyl carbonate] |
| 81 | poly[4,4'-(hexahydro-4,7-methanoidan-5-ylidene)diphenyl carbonate] |
| 82 | poly(4,4'-isopropylidenediphenyl-carbonate-blockoxytetramethylene) |

Especially useful polymers for forming the co-crystalline complexes of the heterogeneous compostions in accordance with the present invention are compounds numbered 28, 30–47, 49, 51, 53, 54 and 76–82 as listed in Table 2 above.

Included among the polymers used for preparing the multiphase heterogeneous compositions, including copolymers, are those linear polymers having the following recurring unit:

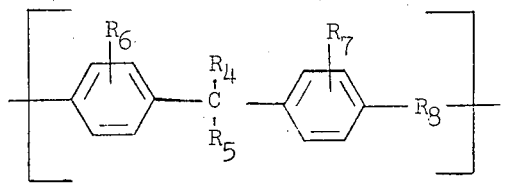

wherein $R_4$ and $R_5$, when taken separately, can each be a hydrogen atom, an alkyl radical such as methyl, ethyl, propyl, isopropyl, butyl, tertiary butyl, pentyl, hexyl, heptyl, octyl, nonyl, decyl and the like including substituted alkyl radicals such as trifluoromethyl, etc., and an aryl radical such as phenyl and naphthyl including substituted aryl radicals having such substituents as a halogen, alkyl radicals of from one to five carbon atoms, etc; and $R_4$ and $R_5$, when taken together, can represent the carbon atoms necessary to form a cyclic hydrocarbon radical including cycloalkanes such as cyclohexyl and polycycloalkanes such as norbornyl, the total number of carbon atoms in $R_4$ and $R_5$ being up to 19; $R_6$ and $R_7$ can each be hydrogen, and alkyl radical of from one to five carbon atoms or a halogen such as chloro, bromo, iodo, etc.; and $R_8$ is a divalent radical selected from the following:

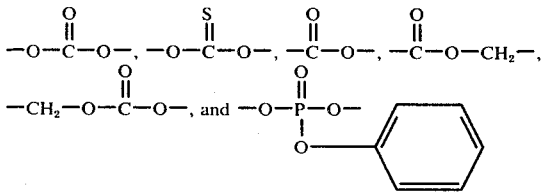

Among the hydrophobic carbonate polymers particularly useful in forming aggregate compositions of the present invention are polymers comprised of the following recurring unit:

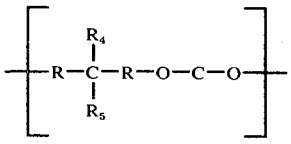

wherein each R is a phenylene radical including halo substituted phenylene radicals and alkyl substituted phenylene radicals; and $R_4$ and $R_5$ are as described above. Such compositions are disclosed, for example, in U.S. Pat. Nos. 3,028,365 and 3,317,466. Preferably, polycarbonates containing an alkylidene diarylene moiety in the recurring unit such as those prepared with Bisphenol A and including polymeric products of ester exchange between diphenylcarbonate and 2,2-bis-4-hydroxyphenyl propane are useful in the practice of this invention. Such compositions are disclosed in the following U.S. Pat. Nos. 2,999,750; 3,038,874;

3,038,879; 3,038,880; 3,106,544; 3,106,545; 3,106,546; and published Australian Patent Specification No. 19575/56.

The present heterogeneous compositions are electrically insulating in the dark such that they will retain in the dark an electrostatic charge applied to the surface thereof. In addition, as mentioned above, the present compositions are also photoconductive. This term has reference to the ability of such compositions to lose a retained surface charge in proportion to the intensity of incident actinic radiation. In general, the term "photoconductive" as used to describe the present heterogeneous compositions means that the amount of incident radiation energy in meter-candle-seconds required to cause a 100-volt reduction in retained surface potential is not greater than about 200-meter-candle-seconds.

The heterogeneous compositions of this invention are typically coated as a photoconductor or as a sensitizer onto a conventional conducting support such as paper (at a relative humidity above 20 percent) including paper made more conductive by various coating and/or sizing techniques or carrying a conducting layer such as a conducting metal foil, a layer containing a semiconductor dispersed in a resin, a conducting layer containing the sodium salt of a carboxyester lactone of maleic anhydride and a vinyl acetate polymer such as disclosed in U.S. Pat. Nos. 3,007,901 and 3,262,806, a thin film of vacuum deposited nickel, aluminum silver, chromium, etc., a conducting layer as described in U.s. Pat. No. 3,245,833, such as cuprous iodide, and like kinds of conducting materials. Such conducting materials can be coated in any well-known manner such as doctor-blade coating, swirling, dip-coating, spraying, and the like. Other supports, including such photographic film bases as poly-(ethylene terephthalate), polystyrene, polycarbonate, cellulose acetate, etc., bearing the above conducting layers can also be used. The conducting layer can be overcoated with a thin layer of insulating material selected for its adhesive and electrical properties before application of a photoconducting layer. Where desired, however, the photoconducting layer can be coated directly on the conducting layer, where conditions permit, to produce the unusual benefits described herein.

When the present multiphase compositions are used as photoconductive compositions, useful results are obtained by using the described dye salts in amounts of from about 1 to about 50 percent by weight of the coating composition. When the present multiphase compositions are used in combination with other photoconductive materials in photoconductive coatings, useful results are obtained by using the described dye salts in amounts of about 0.001 to about 30 percent by weight of the photoconductive coating composition, although the amount used can be widely varied depending upon such factors as individual dye salt solubility; solvent compatibility of the dye salts, the polymer contained in the continuous phase, and any organic photoconductive materials which may be present; etc. The upper limit in the amount of photoconductive composition present in a sensitized layer is determined as a matter of individual choice and the total amount of any photoconductor used will vary widely depending on the material selected, the electrophotographic response desired, the proposed structure of the photoconductive element and the mechanical properties desired in the element.

Coating thicknesses of a photoconductive composition containing the feature material of the invention can vary widely. More generally, a wet coating in the range from about 0.0013 cm. to about 0.13 cm. on a suitable support material is used in the practice of the invention. An especially useful range of wet coating thickness is found to be in the range from about 0.005 cm. to about 0.075 cm.

The present invention can readily be used for enhancing the sensitivity of a variety of organic, including organo-metallic, photoconductors and inorganic photoconductors including both N- and P-type photoconductors. Examples of various categories of photoconductors include the following:

Dessauer and Clark at p. 65 and 165 of "Xerography and Related Process", Focal Press, Ltd., 1965, list a number of useful inorganic photoconductors such as selenium, sulfur, tellurium, zinc oxide, zinc sulfide, cadmium selenide, zinc silicate, cadmium sulfide, arsenic triselenide, antimony trisulfide, lead oxide, titanium dioxide. Other inorganic photoconductors are listed, for example, in Middleton et al., U.S. Pat. No. 3,121,006, issued Feb. 11, 1964.

Arylamine photoconductors including substituted and unsubstituted arylamines, diarylamines, nonpolymeric triarylamines and polymeric triarylamines such as those described in Fox U.S. Pat. No. 3,240,597, issued Mar. 15, 1966, and Klupfel et. al. U.S. Pat. No. 3,180,730 issued Apr. 27, 1965.

Polyarylalkane photoconductors of the types described in Noe et al. U.S. Pat. No. 3,274,000, issued Sept. 20, 1966, Wilson U.S. Pat. No. 3,542,547, issued Nov. 24, 1970; Seus et. al. U.S. Pat. No. 3,542,544, issued Nov. 24, 1970; and in Rule U.S. Pat. No. 3,615,402, issued Oct. 26, 1971.

4-Diarylamino-substituted chalcones of the types described in Fox U.S. Pat. No. 3,526,501, issued Sept. 1, 1970.

Non-ionic cycloheptenyl compounds of the types described in Looker U.S. Pat. No. 3,533,786, issued Oct. 13, 1970.

Compounds containing an >N-N< nucleus, as described in Fox U.S. Pat. No. 3,542,546, issued Nov. 24, 1970.

Organic compounds having a 3,3′-bis-aryl-2-pyrazoline nucleus, as described in Fox et al. U.S. Pat. No. 3,527,602, issued Sept. 8, 1970.

Triarylamines in which at least one of the aryl radicals is substituted by either a vinyl radical or a vinylene radical having at least one active hydrogen-containing group, as described in Brantly et. al. U.S. Pat. No. 3,567,450, issued Mar. 2, 1971.

Triarylamines in which at least one of the aryl radicals is substituted by an active hydrogen-containing group, as described in Brantly et. al. Belgian Patent No. 728,563, dated Apr. 30, 1969.

Organo-metallic compounds having at least one aminoaryl substituent attached to a Group IV*a* or Group V*a* metal atom, as described in Goldman et. al. Canadian patent No. 818,539, dated July 22, 1969.

Organo-metallic compounds having at least one aminoaryl substituent attached to a Group III*a* metal atom, as described in Johnson Belgian Patent No. 735,334, dated Aug. 29, 1969.

Charge transfer combinations, e.g., those comprising a photoconductor and a Lewis acid, as well as photoconductive compositions involving complexes of nonphotoconductive material and a Lewis acid, such as described, for example, in Jones U.S. Defensive Publication No. T881,002, dated Dec. 1, 1970 and Mammino U.S. Pat. Nos. 3,408,181 through 3,408,190, all dated Oct. 29, 1968 and Inami et. al. U.S. Pat. No. 3,418,116, dated Dec. 24, 1968.

Other types of organic photoconductors include azourethanes; heterocyclic compounds such as carbazoles, oxazoles, benzothiazoles, imidazoles, tetrazacyclooctotetraenes etc; aromatic hydrocarbons such as acenaphthene, anthracene, phenanthrene etc. as well as polymers containing the same; aromatic nitro compounds such as 2,4,7-trinitrofluoren-9-one, trinitrobenzene, etc.; ketonic compounds such as benzil, chloranil, benzophenone, etc.; polymeric materials such as polyvinylcarbazole and halogenated counterparts, polymers of formaldehyde and aromatic hydrocarbons, etc., as well as mixtures of such materials with Lewis acids; pigments such as phthalocyanine; dyes such as Rhodamine B, crystal violet, etc.; and many others.

The compositions of the present invention can be employed in photoconductive elements useful in any of the well-known electrophotographic processes which require photoconductive layers. One such process is the xerographic process. In a process of this type, an electrophotographic element held in the dark is given a blanket electrostatic charge by placing it under a corona discharge to give a uniform charge to the surface of the photoconductive layer. This charge is retained by the layer owing to the substantial dark insulating property of the layer, i.e., the low conductivity of the layer in the dark. The electrostatic charge formed on the surface of the photoconductive layer is then selectively dissipated from the surface of the layer by imagewise exposure to light by means of a conventional exposure operation such as, for example, by a contact-printing technique, or by lens projection of an image, and the like, to thereby form an electrostatic latent image in the photoconductive layer. Exposing the surface in this manner forms a pattern of electrostatic charge by virtue of the fact that light energy striking the photoconductor causes the electrostatic charge in the light struck areas to be conducted away from the surface in proportion to the intensity of the illumination in a particular area.

The charge pattern produced by exposure is then developed or transferred to another surface and developed there, i.e., either the charged or uncharged areas rendered visible, by treatment with a medium comprising electrostatically responsive toner particles. The developing electrostatically responsive particles can be in various forms such as small particles of pigment or in the form of small particles comprised of a colorant in a resinous binder. A preferred method of applying such dry toners to an electrostatic latent image for solid area development is by the use of a magnetic brush. Methods of forming and using a magnetic brush toner applicator are described in the following U.S. Pat. Nos. 2,786,439; 2,786,440; 2,786,441; 2,811,465; 2,874,063; 2,984,163; 3,040,704; 3,117,884; and Reissue 25,779. Liquid development of the latent electrostatic image can also be used. In liquid development the developing particles are carried to the image-bearing surface in an electrically insulating liquid carrier. Methods of development of this type are widely known and have been described in the patent literature, for example, U.S. Pat. No. 2,907,674 and in Australian Patent No. 212,315.

In dry developing processes, the most widely used method of obtaining a permanent record is achieved by selecting a developing particle which has as one of its components a low-melting resin. Heating the powder image then causes the resin to melt or fuse into or on the element. The powder is, therefore, caused to adhere permanently to the surface of the photoconductive layer. In other cases, a transfer of the electrostatic charge image formed on the photoconductive layer can be made to a second support such as paper which would then become the final print after development and fusing. Techniques of the type indicated are well known in the art and have been described in a number of U.S. and foreign patents, such as U.S. Pat. Nos. 2,297,691 and 2,551,582 and in "RCA Review" Vol. 15 (1954) pages 469–484.

The following examples are included for a further understanding of the invention.

PREPARATION OF REPRESENTATIVE DYES

EXAMPLE 1

Preparation of 4-(4'-dimethylaminophenyl)-2,6-diphenylthiapyrylium 4-(4'-dimethylaminophenylazo) benzenesulphonate having structural formula II below:

II.

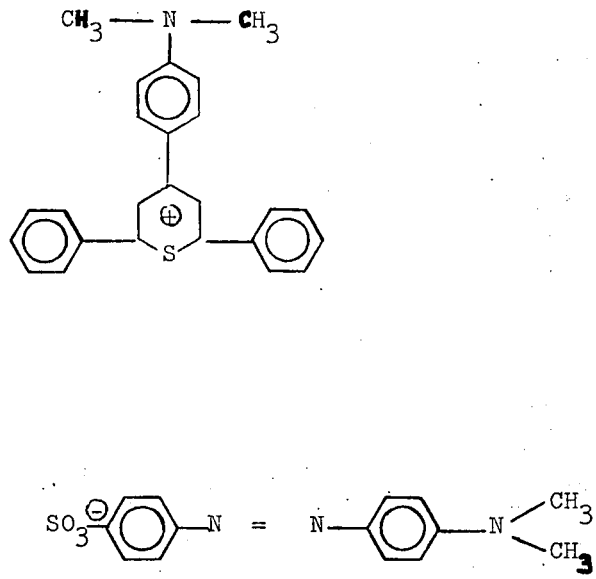

To a solution of 4-(4'-dimethylaminophenyl)-2,6-diphenylthiapyrylium chloride, 8.07 g, in a hot mixture of water, 400 mls, and ethanol, 100 mls, is added a solution of Methyl Orange, E. K. 432, 6.8 g, in hot water, 200 mls, with stirring. The mixture is stirred for 10 minutes and then is cooled and filtered, the filtrate being orange-red in color. The solid product is taken up in boiling nitromethane, filtered hot, evaporated down somewhat, and diluted with ethanol. The solid which crystallizes out overnight is filtered off. Yield: 9.3 g. of product having structural formula II noted above and exhibiting light absorption maxima (when dissolved in ethanol) at 582 and 427 nm.

EXAMPLE 2

Preparation of
2-(4′-ethoxyphenyl)-4-(4′-dimethylaminophenyl)-6-phenylthiapyrylium
4-(4′-dimethylaminophenylazo)benzenesulfonate
having structural formula III below:

III.

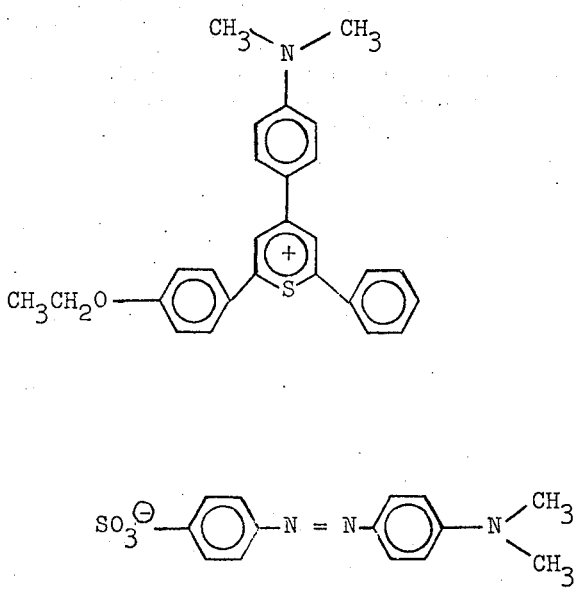

To a solution of 2-(4′-ethoxyphenyl)-4-(4′-dimethylaminophenyl)-6-phenylthiapyrylium chloride, 8.95 g, in a hot mixture of water, 400 mls, and ethanol, 100 mls, is added briskly a solution of Methyl Orange, E.K. 432, 7.0 g, in hot water, 200 mls, containing approximately 25 mls ethanol. Some precipitate comes out of solution immediately and quickly solidifies, and more crystallizes out as the mixture cools. The solid is readily filtered from the cool mixture, and is taken up in hot ethanol, filtered, evaporated down and allowed to cool slowly overnight. The solid that comes down is filtered off and dried at room temperature at 60 mm pressure overnight. Yield 11.1 g having structural formula III noted above and exhibiting light absorption maxima (when dissolved in ethanol) at 578 and 425 nm.

EXAMPLE 3

Preparation of
4-(4′-dimethylaminophenyl)-2,6-diphenylthiapyrylium
4-(4′-diethylaminophenylazo) benzenesulfonate
having structural formula IV below:

IV

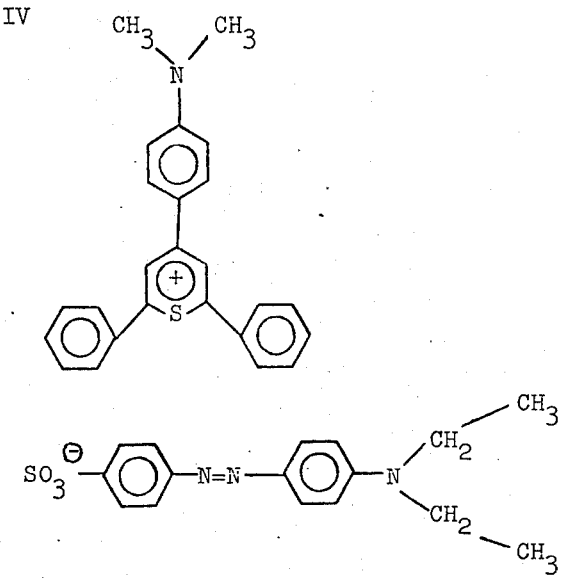

To a solution of 4-(4′-dimethylaminophenyl)-2,6-diphenylthiapyrylium chloride, 8.07 g, in a warm mixture of water, 400 mls, and ethanol, 100 mls, is added a solution of Ethyl Orange, E.K. 122, 7.5 g in warm water, 200 mls, in portions with stirring.

A fine, almost black solid precipitates. The mixture is stirred for a few minutes and then is cooled and filtered. The filtrate is an intense orange-red and the solid collected is washed repeatedly with cold water until the filtrate is light in color. A portion of the solid is taken up in hot acetonitrile, filtered, evaporated down somewhat and allowed to cool overnight. The solid product that comes down is filtered off and dried at 60 mm pressure. The product is analyzed and found to contain: C, 69.7; H, 5.6; N, 7.8; S, 9.0; $C_{41}H_{40}N_4O_3S_2$ requires C, 70.2; H, 5.75; N, 7.99; S, 9.14%. The product is identified as a dye having structural formula IV above and is found to exhibit light absorption maxima (when dissolved in ethanol) at 583 and 438 nm.

EXAMPLE 3*a*

Preparation of 4-(4-dimethylaminophenyl)-2,6-diphenylthiapyrylium 4-(4-dimethylaminophenylazo)-benzoate.

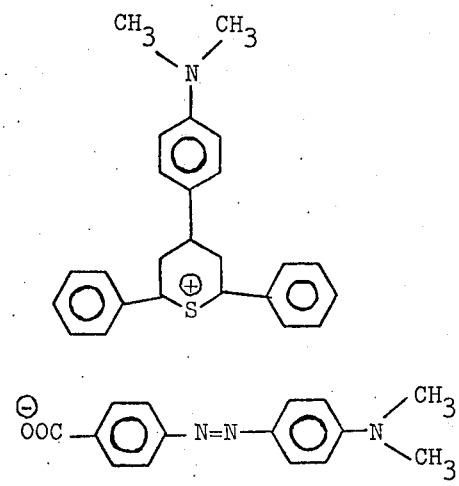

To a hot solution composed of 4.04 g. 4-(4-dimethylaminophenyl)-2,6-diphenylthiapyrylium chloride, 200 mls. water, and 50 mls. ethanol, was added in one portion a solution of sodium 4-(4-dimethylaminophenylazo)benzoate, 3.0 g., in hot water, 150 mls. There was immediate formation of a fine, dark-brown precipitate. The reaction mixture was quickly chilled in ice, and then filtered. The filtrate was a clear, deep orange. The solid was washed with cold water until the washings were only weakly orange. The solid was sucked dry and then a portion of it was dissolved in boiling acetonitrile, filtered hot, and evaporated down. The crystalline solid that came down on cooling the concentrated solution was filtered off and dried in vacuo. This solid was found to contain the above-noted thiapyrylium-azo dye salt.

PREPARATION OF REPRESENTATIVE AGGREGATE PHOTOCONDUCTIVE COMPOSITIONS OF THE INVENTION

EXAMPLE 4

The following formulation is coated at 0.004 inch wet thickness on the nickel surfaces of four identical elements composed of a 0.4 optical density conductive nickel layer which in turn is coated on a poly(ethylene terephthalate support to form four aggregate photoconductive compositions. Particulate aggregate formation is effected using the so-called two-stage dye first method described in U.S. Pat. No. 3,679,408 issued July 25, 1972.

| | |
|---|---|
| Lexan 145 polycarbonate purchased from General Electric Co. | 1.5 g |
| 4,4'-bis(diethylamino)-2,2'-dimethyltriphenylmethane | 1.0 g |
| Pyrylium Type Dye Salt (Total amount) | 0.075 g |
| Dichloromethane | 7.5ml + 6.3ml (2-stage dye first) |

Elements No. 1 and No. 4 are controls outside the scope of the present invention. Little or no aggregate formation is achieved in Element No. 4. As indicated in Table 3 below the difference in composition between Elements Nos. 1–5, is due solely to the pyrylium type dye salt(s) used in each element. Dye A is 4-(4'-dimethylaminophenyl)-2,6-diphenylthiapyrylium fluoroborate, a conventional pyrylium type dye salt useful in known aggregate photoconductive compositions. Dye B is the dye represented by formula II in Example 1 above. The maximum density (i.e., D-max) of each element, relative white light speed using positive and negative charging modes (i.e. relative 100 volt toe speed using a tungsten source at 3000°K) and relative blue light speed using positive and negative charging modes (i.e., relative 100 volt toe speed using a blue filter pack) are measured as shown in Table 3. Complete speed values for Element No. 4 are not obtained as it does not appear to accept charge well. (A fifth element not shown in Table 3 which contains equal parts of Dye A and B also exhibits some difficulty in accepting positive charging; it performs significantly better than Element No. 4 but not as well as Element No. 1.) In examples 4–6 of the present application Relative H & D Electrical Speeds are reported. The relative H & D electrical speeds measure the speed of a given photoconductive material relative to other materials typically within the same test group of materials. The relative speed values are not absolute speed values. However, relative speed values are related to absolute speed values. The relative electrical speed (shoulder or toe speed) is obtained simply by arbitrarily assigning a value, R*o*, to one particular absolute shoulder or toe speed of one particular photoconductive material. The relative shoulder or toe speed, R*n*, of any other photoconductive material, *n*, relative to this value, R*o*, may then be calculated as follows: $Rn = (A_n)\ (Ro/Ao)$ wherein *An* is the absolute electrical speed of material *n*, *Ro* is the speed value arbitrarily assigned to the first material, and *Ao* is the absolute electrical speed of the first material. The absolute H & D electrical speed, either the shoulder (SH) or toe speed, of a material may be determined as follows: The material is electrostatically charged under, for example, a corona source until the surface potential, as measured by an electrometer probe, reaches some suitable initial value $V_o$, typically about 600 volts. The charged element is then exposed to 3000°K tungsten light source through a stepped density gray scale. The exposure causes reduction of the surface potential of the element under each step of the gray scale from its initial potential $V_o$ to some lower potential V the exact value of which depends upon the amount of exposure in meter-candle-seconds received by the area. The results of these measurements are then plotted on a graph of surface potential V vs. log exposure for each step, thereby forming an electrical characteristic curve. The electrical or electrophotographic speed of the photoconductive composition can then be expressed in terms of the reciprocal of the exposure required to reduce the surface potential to any fixed selected value. The actual positive or negative shoulder speed is the numerical expression of $10^4$ divided by the exposure in meter-candle-seconds required to reduce the initial surface potential $V_o$ to some value equal to $V_o$ minus 100. This is referred to as the 100 volt shoulder speed. Sometimes it is desirable to determine the 50 volt shoulder speed and, in that instance, the exposure used is that required to reduce the surface potential to $V_o$ minus 50. Similarly, the actual positive or negative toe speed is the numerical expression of $10^4$ divided by the exposure in meter-candle-seconds required to reduce the initial potential $V_o$ to an absolute value of 100 volts. Again, if one wishes to determine the 50 volt toe speed, one merely uses the exposure required to reduce $V_o$ to an absolute value of 50 volts. An apparatus useful for determining the electrophotographic speeds of photoconductive compositions is described in Robinson et. al., U.S. Pat. No. 3,449,658, issued June 10, 1969.

TABLE 3

| Element No. | Pyrylium Type Dye Salt (Parts by Weight) Dye A | Dye B | D-max Optical Density | Relative 100 Volt Toe Speed: Tungsten 3000°K (+) | (−) | Blue Filter Pack (+) | (−) |
|---|---|---|---|---|---|---|---|
| 1 | 100 | 0 | 3.8 at 685nm | *100 | *100 | *100 | *100 |
| 2 | 85 | 15 | 4.3 at 685nm | 121 | 182 | 116 | 183 |
| 3 | 75 | 25 | 4.2 at 685nm | 121 | 245 | 136 | 300 |
| 4 | 0 | 100 | 0.88 at 576nm (non-aggregation) | 0 [Vo= 440] | | | |

*assigned an arbitrary speed value of 100

The above data indicate that an aggregate photoconductive composition containing an aggregate species containing both Dye A and Dye B produces a level of sensitivity above that of a composition containing either Dye A or Dye B alone. The combination of Dye B and Dye A increases the blue absorption, white light and blue-light speed.

Data are also presented in Table 4 showing density as a function of wavelength for Elements Nos. 1–4 of Table 3.

TABLE 4

| Element No. | Dye A | Dye B | Density (excludes base density) 400nm | 450nm | 500nm | 550nm | 600nm | 650nm | 700nm |
|---|---|---|---|---|---|---|---|---|---|
| 1 | 100 | 0 | 0.80 | 0.02 | 0.14 | 0.58 | 1.24 | 2.08 | 2.30 |
| 2 | 85 | 15 | 0.94 | 0.08 | 0.16 | 0.62 | 1.36 | 2.46 | 2.50 |
| 3 | 75 | 25 | 1.08 | 0.19 | 0.17 | 0.64 | 1.42 | 2.40 | 2.80 |
| 4 | 0 | 100 | 0.78 | 0.64 | 0.42 | 0.78 | 0.79 | 0.48 | 0.18 |

EXAMPLE 5

Two additional aggregate photoconductive coatings similar to those of Example 4 are prepared as described in Example 4. The following data of Table 5 demonstrate the advantage of using an aggregate composition containing a combination of Dye A and Dye D, rather than a combination of Dye A and C. Dye A is the same as Dye A of Example 4. Dye C, like Dye A is another pyrylium type dye salt used in preparing conventional aggregate compositions. Dye C is 4-(4′-dimethylaminophenyl)-2-(4-ethoxyphenyl)-6-phenylthiapyrylium fluoroborate. Dye D is a pyrylium type dye salt as described herein containing a colored anion and specifically is the dye salt of formula III illustrated in Example 2.

TABLE 5

| Element No. | Dye A | Dye C | Dye D | Relative Electrical H & D Speeds (Shoulder/100 volt Toe) Tungsten 3000°K Speeds (+) Sh/100v | Toe (−) | Blue Filter Pack Speeds (+) Sh/100v | Toe (−) |
|---|---|---|---|---|---|---|---|
| 5 | 85 | 15 | — | 100*/14 | 100*/18 | 100*/11 | 100*/17 |
| 6 | 85 | — | 15 | 92/16 | 100/28 | 138/22 | 135/23.5 |

*assigned an arbitrary speed value of 100

Comparative density values are also listed in Table 6 for the above coatings. These show the advantage in blue density for the dye combination consisting of Dye A plus Dye D.

TABLE 6

| Element No. | Dye Combination | Density (excludes support) 400nm | 450nm | 500nm | 550nm | 600nm | 650nm | 700nm |
|---|---|---|---|---|---|---|---|---|
| 5 | A + C | 0.90 | 0.09 | 0.16 | 0.64 | 1.40 | 2.70 | 2.40 |
| 6 | A + D | 1.25 | 0.26 | 0.23 | 0.74 | 1.68 | 3.05 | 3.10 |

EXAMPLE 6

Four additional aggregate photoconductive elements containing various ratios of Dye A and Dye E* are compared in a manner similar to that of Example 4. That is four photosensitive elements are made just as described in Example 4, except that Dye E is used whenever Dye B of Example 4 had been used in Example 4. Element Nos. 7 and 10 are controls outside scope of the invention. (In this Example it may be noted that aggregate formation in Elements Nos. 7–9 is obtained.) The data of Table 7 show the superiority of the Dye E combination with Dye A.

TABLE 7

| Element No. | Dye A | Dye E | D-Max Optical Density | Relative 100 Volt Toe Speed Tungsten 3000°K (+) | (−) | Blue Filter Pack (+) | (−) |
|---|---|---|---|---|---|---|---|
| 7 | 100 | 0 | 4.3 at 685nm | 100* | 100* | 100* | 100* |
| 8 | 85 | 15 | 4.5 at 680nm | 100 | 260 | 167 | 225 |
| 9 | 75 | 25 | 4.4 at 680nm | 100 | 250 | 167 | 250 |
| 10 | 0 | 100 | 1.5 at 572nm | 3.0 | 9.0 | 0 | 0 |

*assigned an arbitrary speed value of 100

* Dye E: 4-(4′-dimethylaminophenyl)-2,6-diphenylthiapyrylium, 4-(4′-diethylaminophenylazo)benzenesulphonate The invention has been described in detail with particular reference to preferred embodiment thereof but it will be understood that variations and modifications can be effected within the spirit and scope of the invention.

We claim:

1. An aggregate photoconductive composition comprising a continuous electrically insulating film-forming polymer phase and at least one discontinuous phase dispersed in said continuous phase, said discontinuous phase comprising a particulate co-crystalline complex of (i) at least one electrically insulating film-forming polymer having an alkylidene diarylene group in the recurring unit thereof, (ii) at least one pyrylium dye salt having a non-light absorbing anion, and (iii) at least one pyrylium dye salt having a colored organo or organo-metallic anion of a strong acid having a pKa of less than about 3.5, said colored anion exhibiting a light absorption maximum within the range of from about 400 to about 700 nm, said particulate complex having a particle size within the range of from about 0.01 to about 25 microns and said complex comprising a weight ratio of said pyrylium dye salt labelled (ii) to said pyrylium dye salt labelled (iii) within the range of from about 1:1 to 9.8:1, said composition comprising a total amount of said pyrylium dye salts labelled (ii) and (iii) of from about 1 to about 50 percent by weight of said composition and said composition comprising an amount of said discontinuous phase sufficient to provide a maximum radiation absorption at a wavelength at least about 10 nm. different from the wavelength of maximum absorption for said dyes labelled (ii) and (iii) solubilized with said polymer labelled (i) in a homogeneous composition.

2. An aggregate photoconductive composition as described in claim 1 wherein said colored anion is an organic group.

3. An aggregate photoconductive composition as described in claim 1 wherein said colored anion contains an azo group and a sulfonic group.

4. An aggregate photoconductive composition comprising (a) a continuous electrically insulating film-forming polymer phase containing a carbonate polymer having an alkylidene diarylene group in a recurring unit and an organic photoconductor dissolved in said carbonate polymer of said continuous phase, said photoconductor different from the thiapyrylium dye salts labelled (ii) and (iii) hereinafter, and (b) at least one discontinuous phase dispersed in said continuous phase, said discontinuous phase comprising a particulate co-crystalline complex of (i) an electrically insulating film-forming carbonate polymer having an alkylidene diarylene group in the recurring unit thereof, (ii) a thiapyrylium dye salt having a non-visible light absorbing anion, and (iii) a thiapyrylium dye salt having a colored organic anion of a strong acid having a pKa of less than about 3.5, said colored anion exhibiting a light absorption maximum within the range of from about 400 to about 700 nm, said particulate complex having a particle size within the range of from about 0.01 to about 25 microns and said complex comprising a weight ratio of said thiapyrylium dye salt labelled (ii) to said thiapyrylium dye salt labelled (iii) within the range of from 1:1 to 9.8:1, said composition comprising a total amount of said thiapyrylium dye salts labelled (ii) and (iii) of from about 0.001 to about 30 percent by weight of said composition and said composition comprising an amount of said discontinuous phase sufficient to provide a maxiumum radiation absorption at a wavelength at least about 10 nm. different from the wavelength of maximum absorption for said dyes labelled (ii) and (iii) solubilized with said polymer labelled (i) in a homogeneous composition.

5. The invention of claim 4 wherein said colored anion contains an azo group and has the following formula:

$$R{-}N{=}N{-}R{-}(N{=}N{-}R)_x$$

wherein $x$ is 0 or 1, and

R represents a carbocyclic aryl group containing 6 to 14 carbon ring atoms, at least one of said R groups containing sulfonic anion substituent.

6. The invention of claim 4 wherein said colored anion is selected from the group of anions having the following formulas:

a.

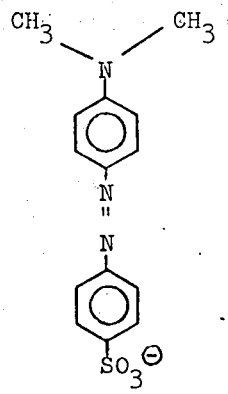

b.

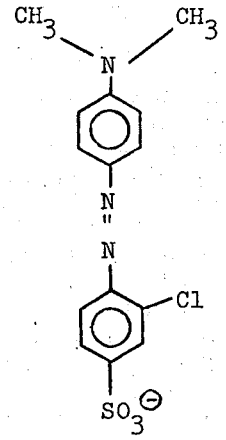

c.

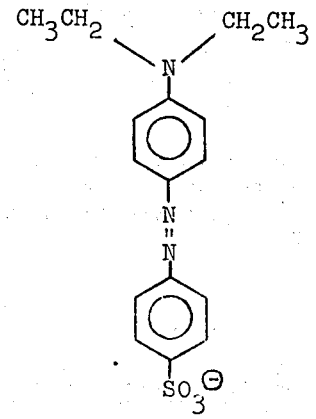

d.

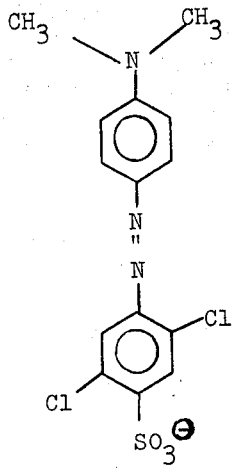

e.

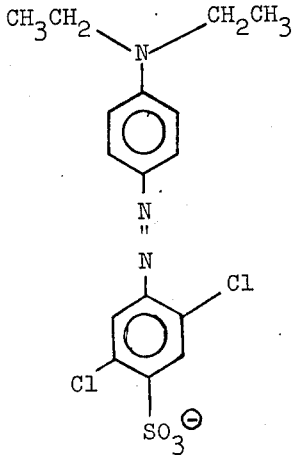

f.

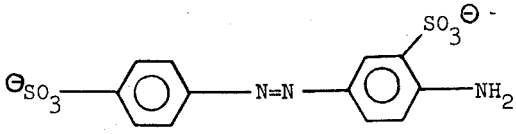

g.

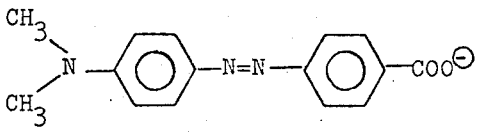

h.

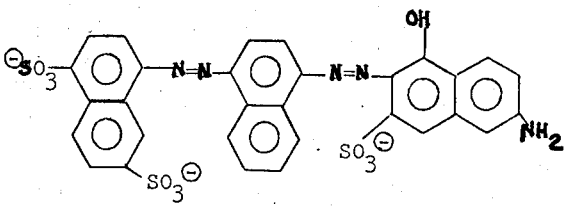

i.

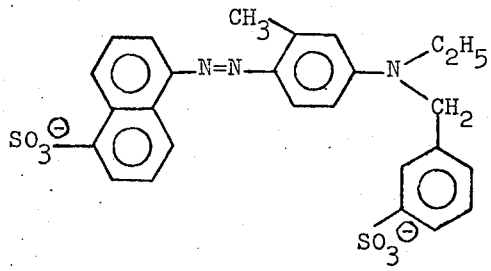

7. An aggregate photoconductive composition comprising a photoconductor different from the pyrylium dye salts labelled (ii) and (iii) hereinafter, a continuous electrically insulating film-forming polymer phase and at least one discontinuous phase dispersed in said continuous phase, said discontinuous phase comprising a particulate co-crystalline complex of (i) at least one electrically insulating film-forming polymer having an alkylidene diarylene group in the recurring unit thereof, (ii) at least one pyrylium dye salt having a non-light absorbing anion, and (iii) at least one pyrylium dye salt having a colored organo or organo-metallic anion of a strong acid having a pKa of less than about 3.5, said colored anion exhibiting a light absorption maximum within the range of from about 400 to about 700 nm, said particulate complex having a particle size within the range of from about 0.01 to about 25 microns and said complex comprising a weight ratio of said pyrylium dye salt labelled (ii) to said pyrylium dye salt labelled (iii) within the range of from about 1:1 to 9.8:1, said composition comprising a total amount of said pyrylium dye salts labelled (ii) and (iii) of from about 0.001 to about 30 percent by weight of said composition and said composition comprising an amount of said discontinuous phase sufficient to provide a maximum radiation absorption at a wavelength at least about 10 nm. different from the wavelength of maximum absorption for said dyes labelled (ii) and (iii) solubilized with said polymer labelled (i) in a homogeneous composition.

* * * * *